US008313171B2

(12) United States Patent
Kura

(10) Patent No.: US 8,313,171 B2
(45) Date of Patent: Nov. 20, 2012

(54) LIQUID JETTING HEAD AND INK-JET PRINTER

(75) Inventor: Keiji Kura, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 131 days.

(21) Appl. No.: 13/018,718

(22) Filed: Feb. 1, 2011

(65) Prior Publication Data

US 2011/0242214 A1 Oct. 6, 2011

(30) Foreign Application Priority Data

Mar. 30, 2010 (JP) ..... 2010-077815

(51) Int. Cl.
*B41J 2/045* (2006.01)

(52) U.S. Cl. ..... 347/68; 347/93

(58) Field of Classification Search ..... 347/68–72, 347/93

See application file for complete search history.

(56) References Cited

U.S. PATENT DOCUMENTS 6,626,522 B2 * 9/2003 Rapp et al. ..... 347/65
6,779,877 B2 * 8/2004 Andrews ..... 347/65
7,537,327 B2 * 5/2009 Kneezel ..... 347/93
2005/0225608 A1 10/2005 Ito
2007/0120913 A1 5/2007 Mukai et al.

FOREIGN PATENT DOCUMENTS

JP 9234886 9/1997
JP 2004-114505 4/2004
JP 2005-231314 9/2005
JP 2007-168421 7/2007

* cited by examiner

*Primary Examiner* — Lamson Nguyen
(74) *Attorney, Agent, or Firm* — Frommer Lawrence & Haug LLP

(57) ABSTRACT

There is provided a liquid jetting head which includes a cavity unit in which a plurality of nozzle rows is formed, a plurality of pressure chambers, and a plurality of common liquid chambers corresponding to the nozzle rows, and a pressure applying mechanism which applies a pressure to the liquid in the pressure chambers. The liquid is supplied to each common liquid chamber, from both end portions in a longitudinal direction of the common liquid chamber, toward a central portion of the common liquid chamber, and a position of an equilibrium point at which a channel resistance of both sides in the longitudinal direction is balanced, is shifted mutually in the longitudinal direction in one of the common liquid chambers and an adjacent common liquid chamber which is adjacent to the one of the common liquid chambers.

13 Claims, 8 Drawing Sheets

LIQUID JETTING HEAD AND INK-JET PRINTER

CROSS REFERENCE TO RELATED APPLICATION

The present application claims priority from Japanese Patent Application No. 2010-077815, filed on Mar. 30, 2010, the disclosure of which is incorporated herein by reference in its entirety.

BACKGROUND OF THE INVENTION

1. Field of the Invention

The present invention relates to a liquid jetting head and an ink-jet printer having the same.

2. Description of the Related Art

As an example of a liquid jetting head, an ink-jet head as described below has hitherto been known, wherein the ink-jet head includes a cavity unit having a plurality of nozzle rows including a plurality of nozzles arranged in the form of rows, a plurality of pressure chambers communicating with the nozzles respectively, a plurality of common ink chambers (common liquid chambers) which are extended in parallel mutually corresponding to the nozzle rows, and which communicate with the pressure chambers, and in which an ink is supplied to the nozzles from the common ink chambers, via the pressure chambers.

At one end portion, of the cavity unit, in a direction of the nozzle row on a rear-surface side (opposite side of nozzles), a plurality of ink supply ports which communicates with the plurality of common ink chambers is formed to be aligned in a direction orthogonal to the direction of the nozzle row.

Consequently, in the abovementioned ink-jet head, the nozzle rows, pressure chamber rows the common ink chambers, and the ink supply ports which are positioned to be overlapping when viewed from a direction of stacking of the plates, correspond by one-to-one relationship. Moreover, a filter for removing dust in the ink is joined at locations (positions) of the plurality of ink supply ports. In other words, the plurality of ink supply ports is covered collectively by one filter.

In recent years, in an ink-jet head of such ink-jet printer, highly densely arranged pressure chambers have been sought for achieving a high product quality and a high image quality of recording by increasing the number of nozzles.

Incidentally, it is necessary to increase an amount of ink supplied to the common ink chamber communicating with the pressure chamber for realizing such highly densely distributed pressure chambers. In Japanese Patent Application Laid-open Nos. 2004-114505 and H09-234886, ink-jet printers which are structured such that the ink is supplied to a common ink chamber through a plurality of ink supply holes for increasing the amount of ink supplied, have been disclosed.

SUMMARY OF THE INVENTION

As shown in FIG. 9A, a case in which ink supply ports 101*a*, 101*b*, 101*c*, and 101*d* and ink supply ports 102*a*, 102*b*, 102*c*, and 102*d* are provided at two end portions in a nozzle-row direction X so that inks of four colors (such as black, yellow, magenta, and cyan) are supplied from the plurality of ink supply holes to respective common ink chambers, is taken into consideration. In this case, the ink is supplied toward a central portion of common ink chambers 103*a*, 103*b*, 103*c*, and 103*d* from two end portions located both sides in the nozzle-row direction X of the common ink chambers 103*a* to 103*d*. In FIG. 9A, reference numeral 104 denotes a piezoelectric actuator.

When the ink is supplied toward the central portion from two end portions in the nozzle-row direction X of the common ink chambers 103*a* to 103*d*, apparent merging points or apparent interflow points Pa, Pb, Pc, and Pd at which flows of inks supplied from the both end portions merge, exist as shown in FIG. 9B. Air bubbles mixed in the ink are removed to a possible extent by a filter. However, since the air bubbles are susceptible to be accumulated due to colliding of the flows of inks near the apparent merging points Pa to Pd, a jetting defect due to the air bubbles is susceptible to occur in the nozzles located near the apparent merging points. Particularly, when positions in the nozzle-row direction X of the apparent merging points Pa to Pd coincide for all the common ink chambers 103*a* to 103*d*, jetting positions due to the nozzles with defective jetting in the nozzle-row direction are aligned together. As a result, when printing is carried out on a recording paper T, as shown in FIG. 9C, a void portion S due to the jetting defect which is because of the presence of the air bubbles appears to be thick in a scanning direction (direction orthogonal to a transport direction of the recording paper) of the ink jet head, and is extremely conspicuous.

Therefore, an object of the present invention is to provide a liquid jetting head which is capable of minimizing such jetting defect, and an ink-jet printer having the liquid jetting head.

According to a first aspect of the present invention, there is provided a liquid jetting head which jets a liquid, including:

a cavity unit which has a nozzle surface in which a plurality of nozzle rows each having a plurality of nozzles arranged in a row is formed, a plurality of pressure chambers which communicate with the nozzles, respectively, and a plurality of common liquid chambers which correspond to the nozzle rows and each of which communicates with the pressure chambers communicating with nozzles included in one of the nozzle rows, the liquid being supplied from the common liquid chambers to the nozzles via the pressure chambers, in the cavity unit; and a pressure applying mechanism which applies a pressure to the liquid in the pressure chambers, wherein the liquid is supplied to each of the common liquid chambers, from two end portions in a longitudinal direction of one of the common liquid chambers, toward a central portion of the one of the common liquid chambers, and a position of an equilibrium point at which a channel resistance of both sides in the longitudinal direction is balanced is shifted mutually in the longitudinal direction, in one of the common liquid chambers and an adjacent common liquid chamber which is located adjacently to the one of the common liquid chambers. The 'position of the equilibrium point' corresponds to a 'position of merging of liquids' which will be described later. Here, 'the position of merging of liquids' is not an apparent position of merging of liquids, or in other words, not a position of merging of pure liquids, but is a position of merging in a schematic sense or an equivalent sense. In such manner, the 'position of merging of liquids' is a position at which a value of channel resistance from each of two end portions of the common liquid chamber (furthermore, liquid supply portion that will be described later) is same, and the value of channel resistance is the maximum. Moreover, 'the position of merging of liquids which are supplied from the two end portions in the adjacent common liquid chambers differs in the direction of the nozzle rows' means that it may be a position which differs not only for the adjacent common liquid chambers, but also for all the common liquid chambers. This is because, it is sufficient that the total amount of liquid supplied to each common liquid chamber from the two end portions is same.

By doing so, an arrangement is made such that the position of merging of liquids which are supplied from two end portions in the adjacent common liquid chambers differ in the direction of the nozzle row. Therefore, positions of nozzles with jetting defect in the direction of nozzle row are not aligned together, and it is possible to make inconspicuous the jetting defect which is due to the presence of air bubbles, without a void portion as mentioned above, appearing to be thick.

According to a second aspect of the present invention, there is provided an ink-jet printer which jets an ink onto a medium to perform printing, including a liquid jetting head according to the first aspect, which jets droplets of the ink onto the medium, an ink supply mechanism which stores the ink and supplies the ink to the liquid jetting head, and a transporting mechanism which transports the medium to a position facing the liquid jetting head.

The ink-jet printer of the present invention is structured so that, as it has been described above, the position of merging of inks (liquids) which are supplied from two end portions of the common liquid chamber, in the adjacent common liquid chambers differs in the direction of nozzle row. The positions of nozzles with defective jetting in the direction of nozzle rows are not aligned together, and is hardly conspicuous.

DETAILED DESCRIPTION OF THE PREFERRED EMBODIMENTS

Figure 1:
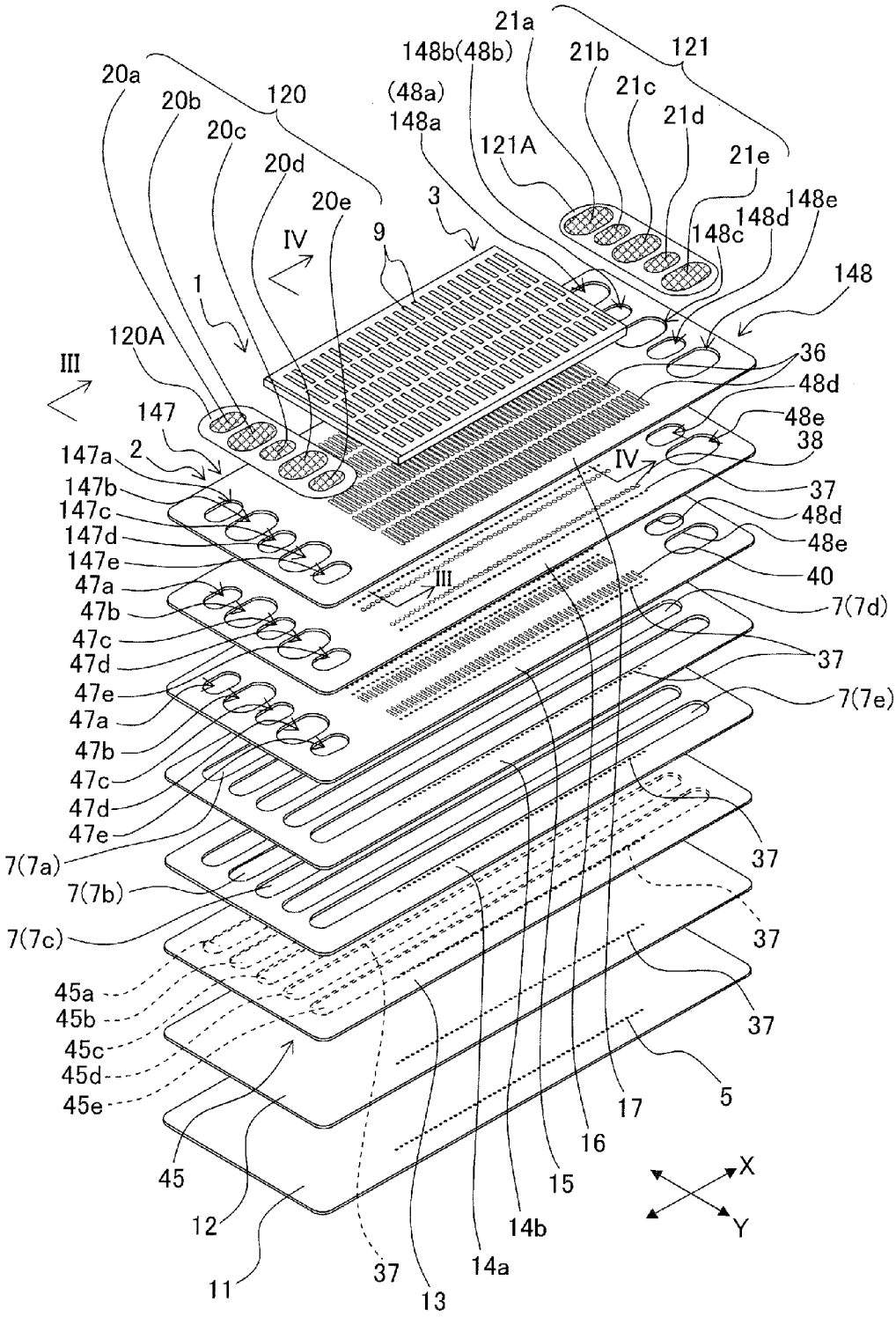
FIG. 1 is an exploded perspective view of a piezoelectric ink-jet printer head which is an embodiment of the present invention, and shows a state in which a cavity unit 2 is disassembled.
Figure 8:
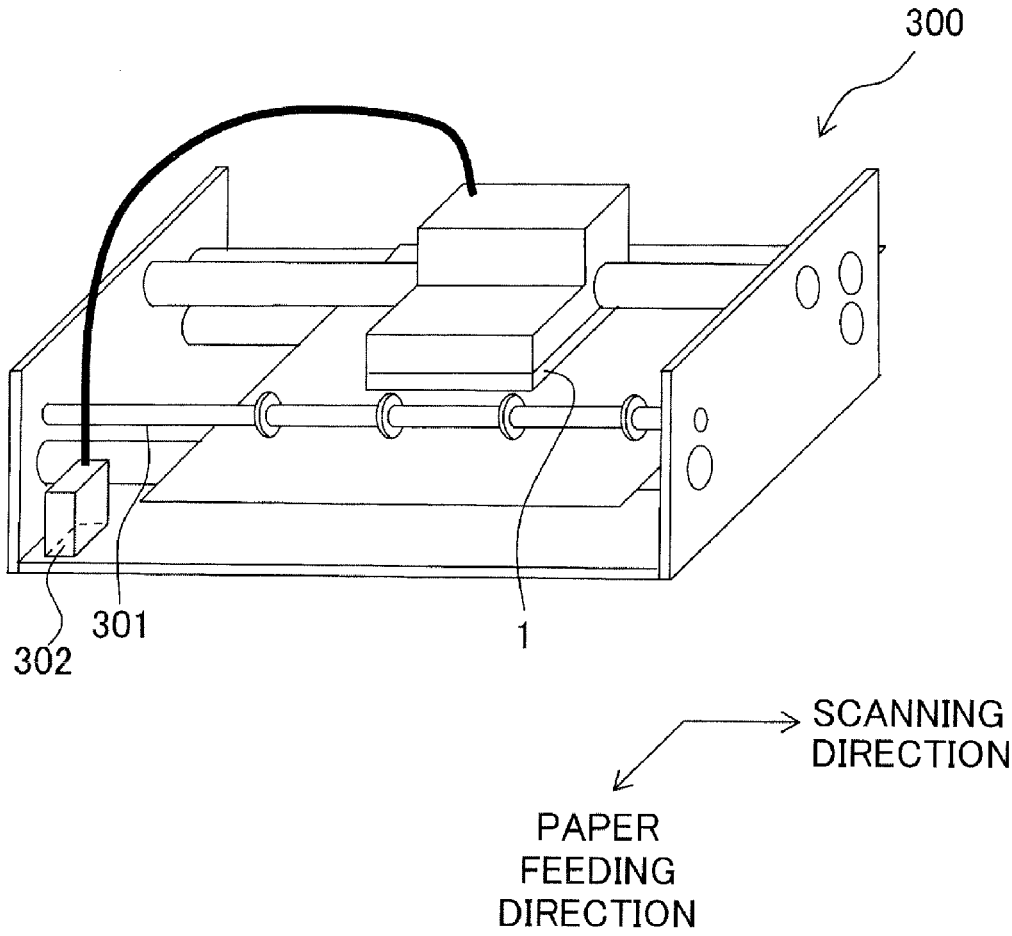
FIG. 8 is a diagram showing an example of an ink-jet printer according to the present teaching.
Figure 9A:
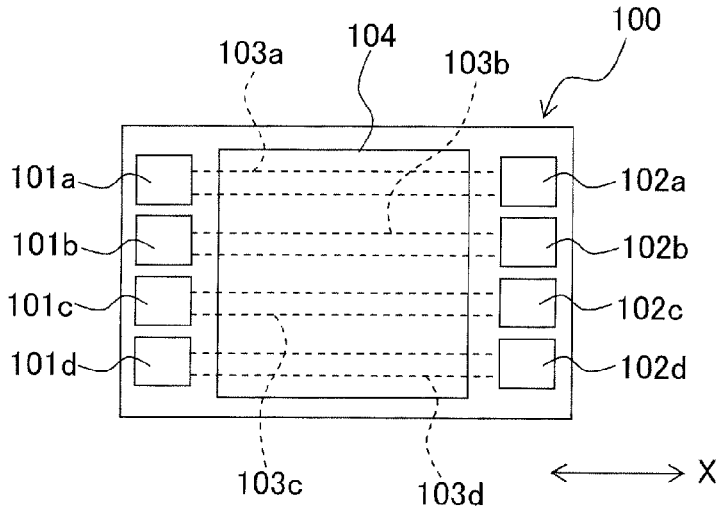
FIG. 9A, FIG. 9B, and FIG. 9C are schematic diagrams of an operation in examples for comparison.
Figure 9B:
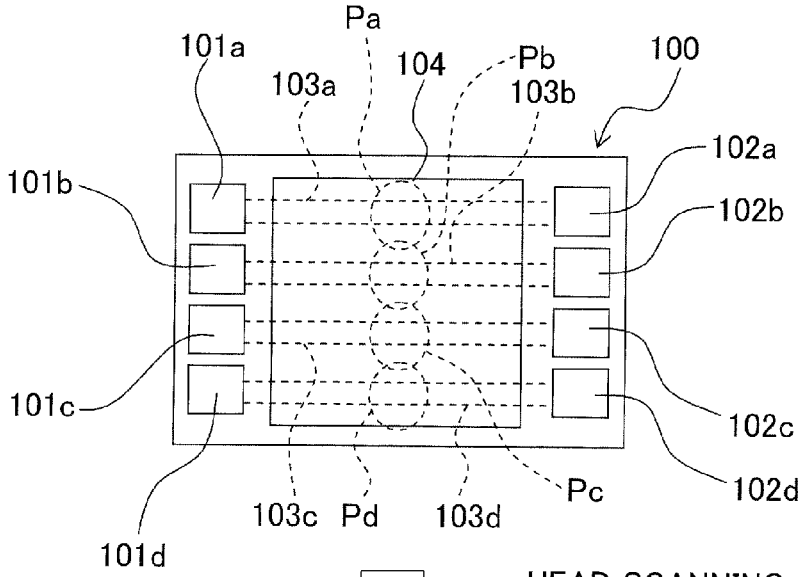
Figure 9C:
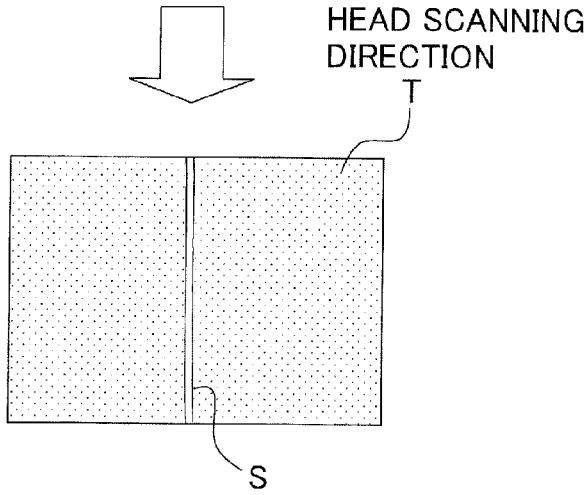

An embodiment of the present invention will be described below with reference to the accompanying diagrams. In this embodiment, the present teaching is applied to an ink-jet printer 300 of a serial type as shown in FIG. 8. However, the present invention is applicable not only to an ink-jet printer of a serial type but also to an ink jet printer of a line type. The ink-jet printer 300 includes mainly an ink-jet head 1, a transporting roller 301 (transporting mechanism) which transports a recording medium such as a recording paper to a position facing the ink-jet head 1, and an ink cartridge 302 which stores the ink and supplies the ink to the ink-jet head 1. As shown in FIG. 1, the ink-jet head 1 has a cavity unit 2 made of a metallic plate, a piezoelectric actuator 3 in the form of a plate which is joined to the cavity unit 2, and a flexible flat cable 4 for connecting to an external equipment, which is joined so that the flexible flat cable 4 overlaps with an upper surface of the piezoelectric actuator 3. The ink is jetted downward from nozzles 5 which are opened in a front surface (lower surface in FIG. 1) of the cavity unit 2.

The cavity unit 2 includes eight thin plates namely, a nozzle plate 11, a first spacer plate 12, a damper plate 13, two manifold plates 14*a* and 14*b*, a second spacer plate 15, a third spacer plate 16, and a base plate 17 which are stacked and joined. The plurality of nozzles 5 for jetting the ink, having a fine diameter are formed in rows at a fine interval corresponding to a resolution at the time of printing, in the nozzle plate 11. The nozzles 5 are arranged to form a plurality of nozzle rows (five nozzle rows in the embodiment) which are arranged in a staggered (zigzag) form along a longitudinal direction X (direction of nozzle row) of the nozzle plate 11.

Moreover, a plurality of pressure chambers 36 which communicate with the nozzles 5 is formed in the base plate 17. The pressure chambers 36 are arranged in five rows in a staggered form along a longitudinal direction X of the base plate 17. The piezoelectric actuator 3 includes a plurality of individual surface electrodes 9 corresponding to the pressure chambers 36, and a common electrode which is not shown in the diagram, but is provided in common to the plurality of individual surface electrodes. A distortion in a stacking direction due to a piezoelectric longitudinal effect in the piezoelectric actuator 3 is occurred by applying a voltage selectively between the common electrode and the individual surface electrode 9, via the flexible flat cable 4. A volume of the pressure chamber 36 corresponding to the individual surface electrode 9 which has been selected is reduced by the distortion, and a jetting pressure is applied to the ink inside the pressure chamber 36. Accordingly, printing is carried out by jetting the ink in the form of droplets from the nozzle 5 communicating with the pressure chamber 36.

Figure 2:
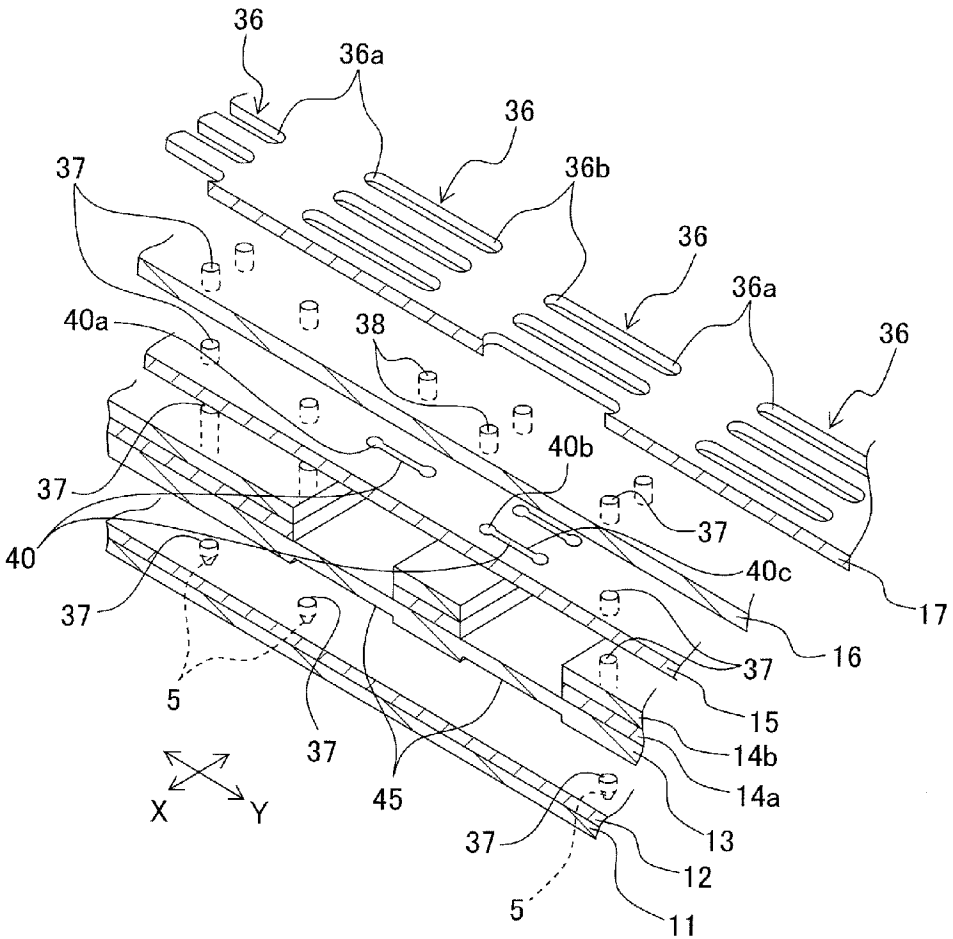
FIG. 2 is an enlarged exploded perspective view of a cavity unit.

As shown in FIG. 2, one end portion 36*a* of the pressure chamber 36 communicates with the nozzle 5, and the other end portion 36*b* of the pressure chamber 36 communicates with a common ink chamber 7 (common liquid chamber). The pressure chamber 36 is formed so that a direction connecting the one end portion 36*a* and the other end portion 36*b* coincide with a longitudinal direction. Each pressure chamber 36 is formed to have a narrow width so that the longitudinal direction thereof is along a short-side direction Y of the base plate 17.

The one end portion 36*a* of each of the pressure chambers 36 communicates with one of the nozzles 5 in the nozzle plate 11 via one of the through holes 37 having a fine diameter, the through holes 37 being formed to be staggered shaped similarly as the pressure chambers 36 in the third spacer plate 16, the second spacer plate 15, the two manifold plates 14*a* and 14*b*, the damper plate 13, and the first spacer plate 12.

Communicating holes 38 each of which is connected to the other end portion 36*b* of one of the pressure chambers 36 are formed in the third spacer plate 16 adjacent to a lower surface of the base plate 17, at positions corresponding to the other end portions 36*b*.

A connecting channel 40 for supplying the ink to each pressure chamber 36 from the common ink chamber 7 that will be described later is provided in the second spacer plate 15 adjacent to a lower surface of the third spacer plate 16. Moreover, an inlet hole 40*a* through which the ink enters from the common ink chamber 7, an outlet hole 40*b* which opens in the communicating hole 38 and which communicates with the pressure chamber 36, and a throttle portion 40*c* which is formed between the inlet hole 40*a* and the outlet hole 40*b*, to be smaller than a cross-sectional area of the outlet hole 40*b*, are formed in each connecting channel 40. The throttle portion 40*c* is formed such that a channel resistance is the maximum in the connecting channel 40, and is formed to have a predetermined channel resistance by carrying out half-etching of an upper surface (surface adjacent to the third spacer plate 16) of the second spacer plate 15. The inlet hole 40*a* and the outlet hole 40*b* are formed to be positioned at two end portions of the throttle portion 40*c*. The inlet hole 40*a* is cut through the second spacer plate 15. The outlet hole 40*b* is formed as a recess (bottomed hole) in the upper surface (surface adjacent to the third spacer plate 16) of the second spacer plate 15.

Five of the common ink chambers 7 which are extended in a longitudinal direction X are formed as through holes in the two manifold plates 14*a* and 14*b*, to be extended in parallel mutually, corresponding to the nozzle row. The manifold plate 14*b* is stacked on an upper surface of the manifold plate 14*a*, and the second spacer plate 15 is arranged to cover an upper surface of the manifold plate 14*b*. Furthermore, the damper plate 13 is arranged to cover a lower surface of the manifold plate 14*a*. Accordingly, the five common ink chambers 7 are formed to be sealed. Each common ink chamber 7, is extended along the direction of row of the pressure chambers 36 to overlap with a part of the pressure chamber 36 when viewed in a direction of stacking of the plates, that is, in a plan view.

Figure 3:
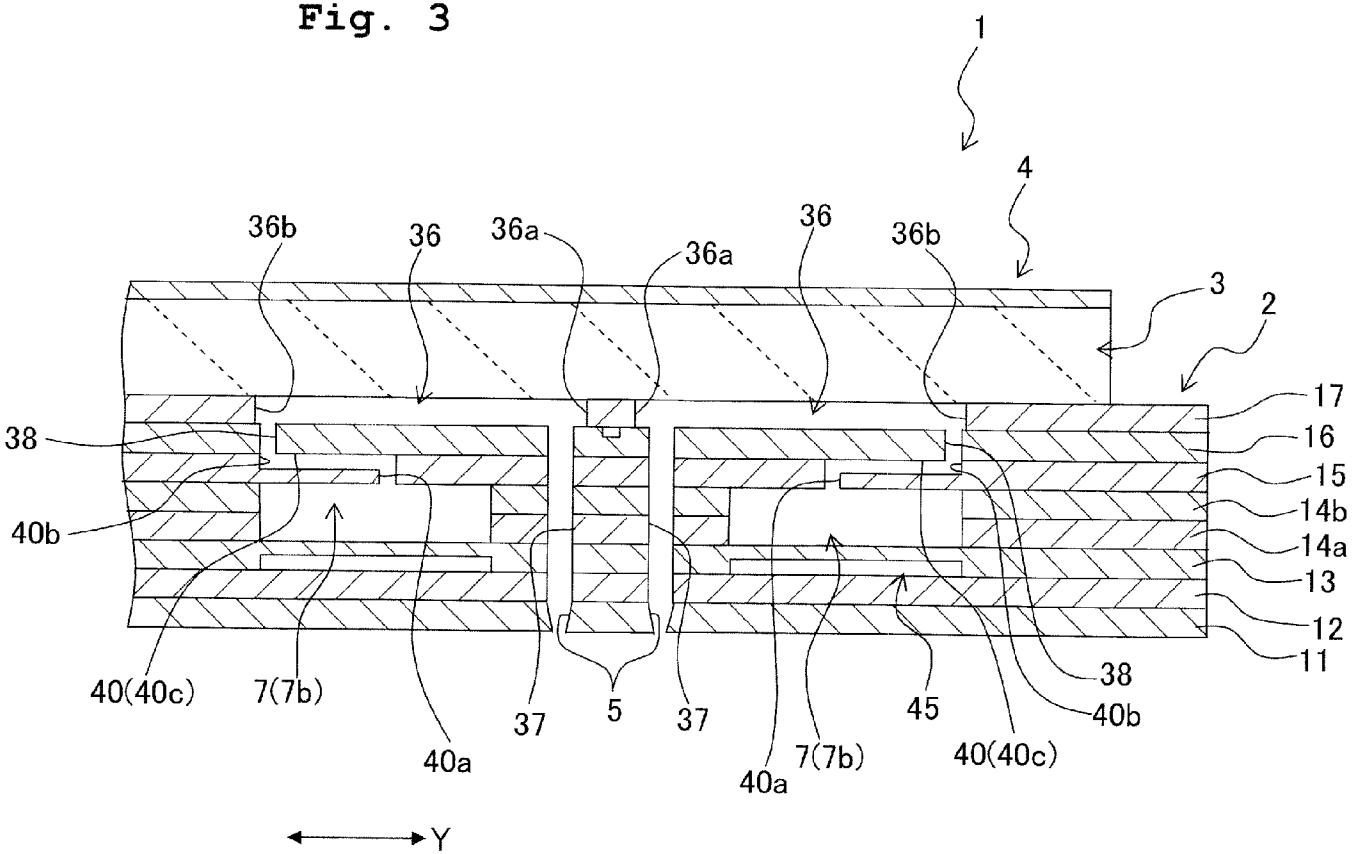
FIG. 3 is an enlarged cross-sectional view along a line III-III in FIG. 1.
Figure 4:
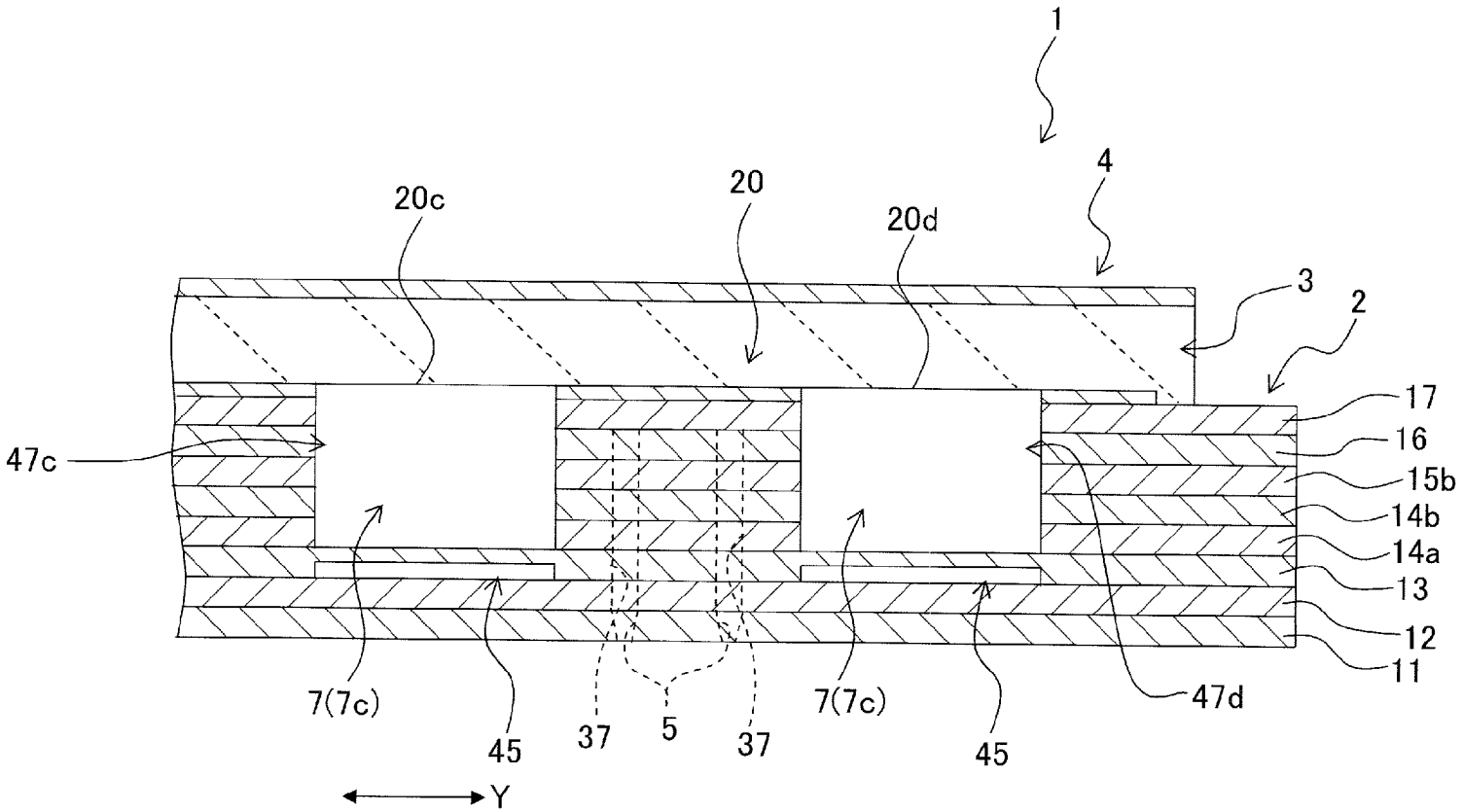
FIG. 4 is an enlarged cross-sectional view along a line IV-IV in FIG. 1.

As shown in FIGS. 2 and 3, a damper chamber 45 which is isolated from the common ink chamber 7 is formed as a recess in a lower surface of the damper plate 13 adjacent to the lower surface of the manifold plate 14*a*. Regarding a position and a shape of the damper chambers 45, the damper chambers 45 are formed so that the damper chambers 45 almost coincide with the common ink chambers 7. Since the damper plate 13 is formed of a metallic material which can be deformed elastically, a bottom portion in the form of a thin plate of the damper chamber 45 is capable of vibrating freely toward the common ink chamber 7 and also toward the damper chamber 45. At the time of jetting the ink, even when a pressure fluctuation generated in the pressure chamber 36 is propagated to the common ink chamber 7, since the bottom plate portion is vibrated by elastic deformation, the pressure fluctuation is absorbed and attenuated (damper effect). By such damper effect, it is possible to prevent a cross-talk in which the pressure fluctuation is propagated to another pressure chamber 36.

The cavity plate 2 is formed by positioning and stacking the eight thin plates 11 to 17 which are formed as described above, and by joining the eight thin plates 11 to 17. Accordingly, as shown in FIG. 3, the common ink chamber 7 which is extended in the longitudinal direction X in the cavity unit 2 is formed. Furthermore, individual ink distribution channels are formed, which run from the inlet holes 40*a* of the connecting channels 40 opened in the common ink chambers 7 up to the nozzles 5 via the communicating holes 38, the pressure chambers 36, and the through holes 37 successively.

Moreover, as shown in FIG. 1, a plurality of first ink supply ports (first liquid supply portions) 147 which communicate with the one end portions respectively of the common ink chambers 7 is formed at one end side in the longitudinal direction X (direction of nozzle row), of a rear-surface side of the cavity unit 2. A plurality of second ink supply ports 148 (second liquid supply portions) which communicate with the other end portions respectively of the common ink chambers 7 is formed at the other end side in the longitudinal direction X, of the rear-surface side of the cavity unit 2.

Five first ink supply ports 147 and five second ink supply ports 148 are formed by through holes which are formed in two end portions of the base plate 17, the second spacer plate 15, and the third spacer plate 16. As shown in FIG. 1, five through holes 47*a*, 47*b*, 47*c*, 47*d*, and 47*e* which form the first ink supply port 147 are formed at an end portion on one side (left side in FIG. 1) of the base plate 17, the second spacer plate 15, and the third spacer plate 16. Moreover, five through holes 48*a*, 48*b*, 48*c*, 48*d*, and 48*e* which form the second ink supply port 148 are formed at an end portion on the other side (right side in FIG. 1) of the base plate 17, the second spacer plate 15, and the third spacer plate 16. The through holes 47*a* to 47*e* and the through holes 48*a* to 48*e* are positioned to communicate mutually in a vertical direction. Moreover, the through holes 47*a* to 47*e* and the through holes 48*a* to 48*e* are formed to be aligned along a short-side direction Y, at two end portions in the longitudinal direction X of the plates.

The cavity unit 2 is structured such that, in each common ink chamber 7, a flow velocity of ink (flow velocity of liquid) in the first ink supply port 147 is different from a flow velocity of ink in the second ink supply port 148. Furthermore, the cavity unit 2 is structured such that, the flow velocity of ink in the first ink supply port 147 differs in the two adjacent common ink chambers 7, and the flow velocity of ink in the second ink supply port 148 differs in the two adjacent common ink chambers 7.

In the embodiment, as shown in FIG. 1, five common ink chambers 7 are provided, and five first ink supply ports 147 and five second ink supply ports 148 are provided on the left side and the right side of the common ink chambers, respectively. The five first ink supply ports 147 include the first ink supply ports 147*a*, 147*b*, 147*c*, 147*d*, and 147*e* arranged in this order from the left side in FIG. 1, and five second ink supply ports 148 include the second ink supply ports 148*a*, 148*b*, 148*c*, 148*d*, and 148*e* arranged in this order from the left side in FIG. 1. The common ink chambers 7, which communicate with the five first ink supply ports 147 (147*a* to 147*e*) and the five second ink supply ports 148 (148*a* to 148*e*), include the common ink chambers 7*a*, 7*b*, 7*c*, 7*d*, and 7*e* arranged in this order from the left side in FIG. 1.

Setting is carried out so that the black ink is supplied to the first ink supply ports 147*a* and 147*b*, and the second ink supply ports 148*a* and 148*b*. The first ink supply ports 147*a*, 147*b* and the second ink supply ports 148*a*, 148*b* communicate with the two common ink chambers 7*a*, 7*b* respectively, which are arranged on the left side in FIG. 1. When a recording speed for a monochrome recording is faster (higher) than a recording speed for a color recording, consumption per unit time of the black ink becomes more than consumption per unit time of other color inks. Therefore, taking this into consideration, two common liquid chambers 7*a* and 7*b* have been allotted.

Inks of yellow, magenta, and cyan color are supplied individually to the first ink supply ports 147*c*, 147*d*, and 147*e* respectively. Similarly, the inks of yellow, magenta, and cyan color are supplied individually to the second ink supply ports 148*c*, 148*d*, and 148*e* respectively. The first ink supply port 147*c* and the second ink supply port 148*c* communicate with two end portions of the corresponding common ink chamber 7*c*. Similarly, the first ink supply port 147*d* and the second ink supply port 148*d* communicate with end portions of the corresponding common ink chamber 7*d*, and the first ink supply port 147*e* and the second ink supply port 148*e* communicate with end portions of the corresponding common ink chamber 7*e*(refer to FIG. 5).

The corresponding first ink supply port and the second ink supply port, and end portions (a first end portion and a second end portion) in the longitudinal direction X of the common ink chamber are positioned to almost overlap when viewed from the stacking direction of the plates, as is the case with the first and second ink supply port 147*a*, 148*a* and the common ink chamber 7*a*. The arrangement is similar for the other first ink supply ports 147*b* to 147*e* and the second ink supply ports 148*b* to 148*e*, and the corresponding ink supply chambers 7*b* to 7*e*.

Recesses and through holes etc. which form the first ink supply ports 147 and the second ink supply ports 148, the common ink chambers 7, the through holes 37, the communicating holes 38, the connecting channels 40, and the damper chambers 45 in the metallic plates 12 to 17 are formed by a method such as, an etching, an electric discharge processing, a plasma processing, and laser machining.

Moreover, a first filter body 120 and a second filter body 121 in the form of a substantially rectangular sheet in a plan view are joined by an adhesive to a rear surface of the base plate 17 in which the first ink supply port 147 and the second ink supply port 148 are formed, so that the first and second filter body 120, 121 cover all the first ink supply ports 147*a* to 147*e* and the second ink supply ports 148*a* to 148*e*, respectively. The first filter body 120 and the second filter body 121 are made of a material such as a thin metal, ceramics, and a synthetic resin such as polyimide. First filters 20*a*, 20*b*, 20*c*, 20*d*, and 20*e* for removing impurities, dust, and foreign matter in the ink supplied from an ink tank (not shown in the diagram) are formed in a portion of the first filter body 120, overlapping with the first ink supply ports 147*a* to 147*e*. Similarly, second filters 21*a*, 21*b*, 21*c*, 21*d*, and 21*e* for removing impurities, dust, and foreign matter in the ink supplied from the ink tank (not shown in the diagram) are formed in a portion of the second filter body 121, overlapping with the second ink supply ports 148*a* to 148*e* (refer to FIG. 1).

The first filter body 120 includes the first filters 20*a* to 20*e* which are provided to or formed in a first base member 120A, and the second filter body 121 includes the second filters 21*a* to 21*e* which are provided to or formed in a second base member 121A. The first filters 20*a* to 20*e* and the second filters 21*a* to 21*e* almost overlap with the corresponding first ink supply ports 147*a* to 147*e* and the second ink supply ports 148*a* to 148*e*, respectively, when the first filters 20*a* to 20*e* and the second filters 21*a* to 21*e* are installed on the base plate 17. The surrounding area (the first base member 120A) of the first filters 20*a* to 20*e* in the first filter body 120 and the surrounding area (the second base member 121A) of the second filters 21*a* to 21*e* in the second filter body 121 are the areas for sticking to the base plate 17.

Here, a plurality of holes each having a fine diameter and penetrating the filter body in a thickness direction thereof may be formed by a method such as an electrocasting (electroforming), the plasma processing, and the laser machining, for forming integrally the filters and the filter body made of a metallic material. Moreover, a shape of the filter is not restricted to a substantially oval shape, and may be an elliptical shape, a rectangular shape, or a polygonal shape.

It is possible to form the first filter body 120 and the second filter body 121 not only by installing the first filters 20*a* to 20*e* and the second filters 21*a* to 21*e* on the first base member 120A and the second base member 121A, but also by sticking the separate first filters 20*a* to 20*e* and the second filters 21*a* to 21*e* directly to the base plate 17.

Taking into consideration an installation error at the time of joining the first filter body 120 and the second filter body 121, the first filters 20*a* to 20*e* and the second filters 21*a* to 21*e* are formed to be slightly larger than the corresponding first ink supply ports 147*a* to 147*e* and the second ink supply ports 148*a* to 148*e*. Moreover, regarding the first filters 20*a* to 20*e*, an effective area (area of opening) of the first filter 20*b* for the black ink and the first filter 20*d* for the magenta ink is formed to be more (wider) than an effective area of the first filter 20*a* for the black ink, the first filter 20*c* for the yellow ink, and the first filter 20*e* for the cyan ink. Regarding the second filters 21*a* to 21*e*, an effective area of the second filter 21*a* for the black ink, the second filter 21*c* for the yellow ink, and the second filter 21*e* for the cyan ink is formed to be more (wider) than an effective area of the second filter 21*b* for the black ink and the second filter 21*d* for the magenta ink. The first filters 20*a* to 20*e* and the second filters 21*a* to 21*e* of all the colors are formed to have same hole diameter (mesh size). However, the first filters 20*a* to 20*e* and the second filters 21*a* to 21*e* are formed so that an effective area of the first filter body 120 provided to the first ink supply port 147 is different from an effective area of the second filter body 121 provided to the second ink supply port 148 communicating with certain common ink chamber. Furthermore, the first filters 20*a* to 20*e* and the second filters 21*a* to 21*e* are formed so that the effective area is different for the adjacent first filter body 120 and the second filter body 121. In the embodiment, the first filters 20*b*, 20*d* (the second filters 21*a*, 21*c*, and 21*e*) having a large effective area at end portions and the first filters 20*a*, 20*c*, and 20*e* (the second filters 21*b* and 21*d*) having a small effective area at the end portions are arranged alternately. In the embodiment, the filters for all the colors (the first filters 20*a* to 20*e* and the second filters 21*a* to 21*e*) are formed so that the hole diameter (mesh size) is same for all the filters, and two types of filters namely, the first filters 20*b* and 20*d* (the second filters 21*a*, 21*c*, and 21*e*) having the large effective area and the first filters 20*a*, 20*c*, and 20*e* (the second filters 21*b* and 21*d*) having the small effective area are used in combination. However, the present teaching is not restricted to a combination of two types of filters. For instance, when the common ink chambers 7*a* to 7*c* are formed so that the sum of a resistance value (fluid resistance) for each common ink chamber is same, the filters may be formed so that the effective area of the first filters 20*a* to 20*e* in the first filter body 120 and the second filters 21*a* to 21*e* in the second filter body 121 is same for all the common in chambers.

Since the effective area (area of opening) of the first filters 20*a* to 20*e* of the first filter body 120 and the effective area of the second filters 21*a* to 21*e* of the second filter body 121 located at both ends of the common ink chambers 7*a* to 7*e* differs mutually, it is possible to change a resistance at the time when the ink passes through the first filters 20*a* to 20*e* and the second filters 21*a* to 21*e*. In this case, the flow velocity of ink in the first ink supply ports 147*a* to 147*e* and the flow velocity of ink in the second ink supply ports 148*a* to 148*e* differ mutually.

In the structure described above, after the foreign matter in the ink which inflows from the ink tank (not shown in the diagram) into the cavity unit is trapped (removed) by the first filters 20*a* to 20*e* of the first filter body 120 and the second filters 21*a* to 21*c* of the second filter body 121, the ink is supplied to the common ink chambers 7*a* to 7*e* through the first ink supply ports 147*a* to 147*e* and the second ink supply ports 148*a* to 148*e*. Accordingly, the ink is supplied from the end portion at two ends in the longitudinal direction X (direction of nozzle row) to the central portion in the common ink chambers 7*a* to 7*e*. Accordingly, it is possible to facilitate an increase in the amount of ink supplied to the common ink chamber 7 (7*a* to 7*e*).

Next, the ink is distributed and supplied to the other end of each pressure chamber 36 via the through hole 38 formed in the third spacer plate 16 and the connecting channel 40 formed in the second spacer plate 15 as shown in FIG. 2. Thereafter, the ink reaches the nozzle 5 corresponding to the pressure chamber 36 upon passing through the through hole 37 from each pressure chamber 36 by a drive of the piezoelectric actuator 3, as it will be described later, and the ink is used for printing on the recording paper.

Figure 5:
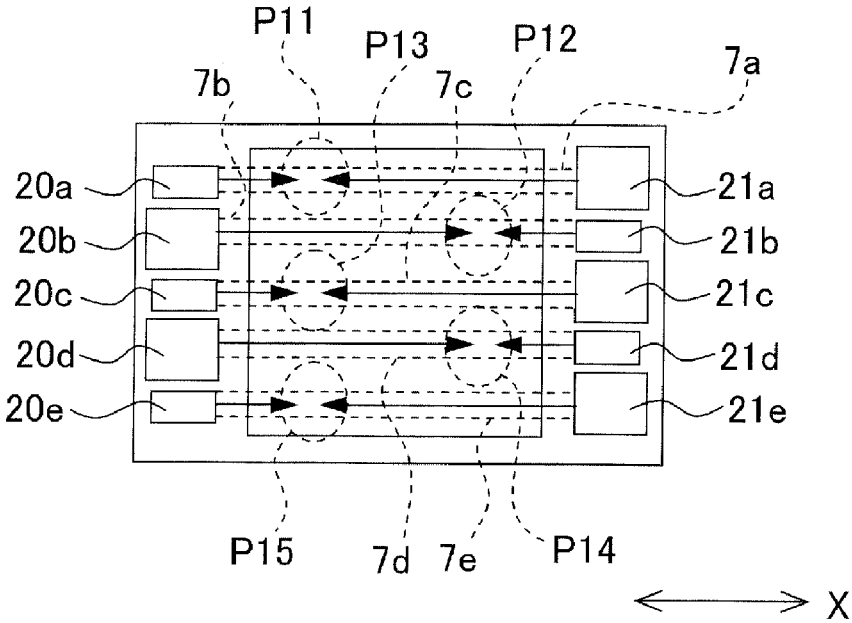
FIG. 5 is a schematic diagram of an operation.

As described above, since the effective areas of the first filters 20*a* to 20*e* is difference from the effective areas of the second filters 21*a* to 21*e* at two ends of the common ink chambers 7*a* to 7*e*, the flow velocity of ink in the first ink supply ports 147*a* to 147*e* is different from the flow velocity of ink in the second ink supply ports 148*a* to 148*e* in the common ink chambers 7*a* to 7*e*. Furthermore, the effective areas of the adjacent filters are different from each other in the first filter body 120 and the second filter body 121. Therefore, the flow velocities of ink in the first ink supply ports differ for the two adjacent common ink chambers, and the flow velocities of ink in the second ink supply ports differ for the two adjacent common ink chambers. Therefore, as shown in FIG. 5, in the common ink chambers 7*a* to 7*e*, apparent positions of merging P11, P12, P13, P14, and P15 of the ink which is supplied from the two end portions in the adjacent common ink chambers are misaligned or shifted in the longitudinal direction X (direction of nozzle row). Therefore, it is possible to make an arrangement such that the positions of the nozzles which are susceptible to jetting defect are not aligned together. As a result, a void portion which is developed on the recording paper based on the jetting defect due to the presence of air bubbles as described above, and the void portion is not conspicuous.

The present invention is not restricted to the abovementioned embodiment and it is possible to make the following modifications.

In the embodiment described above, the common ink chamber for the black ink includes two common ink chambers 7*a* and 7*b* for the abovementioned reason. However, the common ink chamber for the black ink may be one common ink chamber similarly as for the inks of other colors.

In the abovementioned embodiment, the flow velocity of ink in the first ink supply port 147 and the second ink supply port 148 is adjusted by adjusting the channel resistance of the filter by changing the effective area of the filters in the first filter body 120 and the second filter body 121. However, the present teaching is not restricted to such an arrangement. For instance, the channel resistance of the filter may be adjusted by making same the effective area of the first filters 20*a* to 20*e* and the second filters 21*a* to 21*e* of the first filter body 120 and the second filter body 121, and changing the hole diameter (mesh size) of the filter. Or, the channel resistance of the filter may be adjusted by changing both the effective area of the filter and the hole diameter (mesh size) of the filter. It is also possible to adjust the flow velocity of ink in the first ink supply port 147 and the second ink supply port 148 by adjusting the channel resistance in the first ink supply port 147 and the second ink supply port 148 by changing the effective area (cross-sectional area) of the first ink supply ports 147*a* to 147*e* and the second ink supply ports 148*a* to 148*e*.

Figure 6:
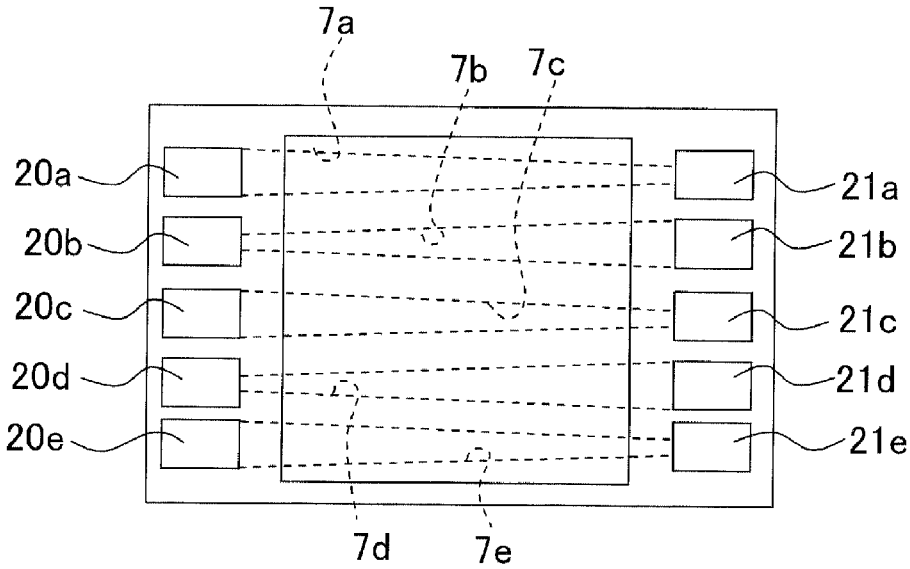
FIG. 6 is a schematic diagram showing a common channel having a different cross-sectional area distribution.

Moreover, the channel resistance of the filter may be adjusted by adjusting an aperture rate of the filter which is defined by a ratio of sum total of the area of the opening of the filter with respect to the effective area of the filter. Or, the channel resistance of the filter may be adjusted by adjusting a length of the through hole of the filter (in other words, a thickness of the filter). Or, the mutually adjacent common channels 7 (common ink chambers 7) may be formed so that a distribution of the channel resistance in the longitudinal direction differs. For instance, the mutually adjacent common channels 7 (common ink chambers 7) may be formed so that, a distribution of the cross-sectional area in the longitudinal direction varies as shown in FIG. 6. In such manner, the shape, the material, and the arrangement of the ink supply port, the common channel, and the filter may be set appropriately so that a point of equilibrium in each common channel 7 varies in the adjacent common channels. Here, the point of equilibrium of the channel resistance is a point at which the channel resistance is mutually same at two side (both sides) of that point (both sides of the longitudinal direction of the common channel), and corresponds to the above-mentioned apparent merging point. Even in a case in which each of the shape etc. of the filter, the common channel, and the ink supply port is set to be same, it is possible to misalign (shift) mutually the point of equilibrium of the channel resistance in the adjacent common channels by arranging the common channels mutually differently in the longitudinal direction.

Figure 7:
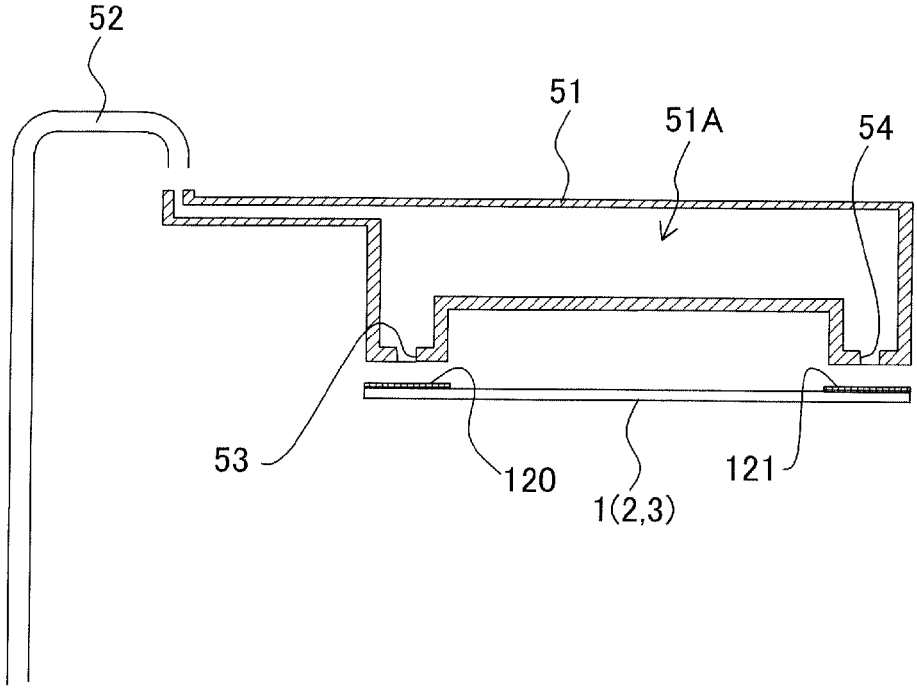
FIG. 7 is a schematic diagram of a modified embodiment.

Moreover, an auxiliary channel unit 51 which includes a plurality of ink chambers 51A to be connected to the plurality of first ink supply ports 147 (147*a* to 147*e*) and the second ink supply ports 148 (148*a* to 148*e*) via the first filter body 120 (the first filters 20*a* to 20*e*) and the second filter body 121 (the second filters 21*a* to 21*e*), and which distributes and supplies the ink to the first ink supply port 147 and the second ink supply port 148 may be connected to the ink-jet head 1. In this case, the plurality of ink chambers 51A which are formed in the auxiliary channel unit 51 are formed so that the flow velocity of ink in the first ink supply port 147 in each common ink chamber 7 and the flow velocity of ink in the second ink supply port 148 differ. At the same time, the plurality of ink chambers 51A is formed so that the flow rate of ink in the first ink supply ports in the two adjacent common ink chambers 7 differs mutually, and also, the flow velocity of ink in the second ink supply ports in the two adjacent common ink chambers 7 differs mutually. Accordingly, it is possible to have a similar effect. Moreover, in FIG. 7, an ink supply pipe 52 which communicates with the ink tank which is not shown in the diagram is connected to the auxiliary channel unit 51. The plurality of ink chambers 51A includes a first connecting port (connecting portion) 53 to be connected to the first ink supply port 147, and a second connecting port (connecting portion) 54 to be connected to the second ink supply port 148. For instance, it is possible to vary the flow velocity of ink in the first ink supply port 147 and the second ink supply port 148 by changing the area of opening of the first connecting port (ink supply port) 147 and the second connecting port (ink supply port) 148. Moreover, it is also possible to make an arrangement to change an internal shape of each ink chamber 51A so that the flow velocity of ink differs as mentioned above.

The liquid jetting head is not restricted to an ink-jet head. The liquid jetting head is also applicable to other liquid jetting heads such as a liquid jetting head which applies a colored liquid (coloring liquid) as fine liquid droplets, or which forms a wiring pattern by jetting an electroconductive liquid.

Regarding a medium on which a liquid is to be jetted, it is possible to use not only a recording paper but also various types of media such as a resin and a cloth. Moreover, regarding a liquid to be jetted, it is possible to use not only an ink but also various liquids such as a colored liquid (coloring liquid), a functional liquid, a pretreatment liquid, and an image-quality improving liquid. The type of ink to be supplied from the ink supply port is not restricted to the abovementioned color inks, and may include liquids such as a glazing liquid. Any type of color ink may be used.

Regarding a shape in a plan view of the ink supply port, it is possible to use various shapes such as a substantially circular shape, a substantially oval shape, an elliptical shape, a rectangular shape, and a polygonal shape. Here, it is needless to mention that the ink supply port should be formed to be elongated in the longitudinal direction of the cavity plate as viewed in the stacking direction, when a short side of the cavity unit (a width of the cavity unit) is shortened. Moreover, the number of the ink supply ports is not restricted to the number in the abovementioned embodiment, and may be set arbitrarily according to the requirement.

In a case of applying the present teaching to an ink-jet head, the present teaching is applicable not only to an ink-jet head of a serial type but also to a line head having nozzle rows of a length longer than a width of a recording paper. Moreover, regarding a method of drive of the ink-jet head, it is possible to use a type such as a piezoelectric type, an electrostatic suction type, and an electro-thermal conversion type (a thermal type).

What is claimed is:

1. A liquid jetting head which jets a liquid, comprising:

a cavity unit which has a nozzle surface in which a plurality of nozzle rows each having a plurality of nozzles arranged in a row is formed, a plurality of pressure chambers which communicate with the nozzles, respectively, and a plurality of common liquid chambers which correspond to the nozzle rows and each of which communicates with the pressure chambers communicating with nozzles included in one of the nozzle rows, the liquid being supplied from the common liquid chambers to the nozzles via the pressure chambers, in the cavity unit; and a pressure applying mechanism which applies a pressure to the liquid in the pressure chambers, wherein the liquid is supplied to each of the common liquid chambers, from two end portions in a longitudinal direction of one of the common liquid chambers, toward a central portion of the one of the common liquid chambers, and a position of an equilibrium point at which a channel resistance of both sides in the longitudinal direction is balanced is shifted mutually in the longitudinal direction, in one of the common liquid chambers and an adjacent common liquid chamber which is located adjacently to the one of the common liquid chambers.

2. The liquid jetting head according to claim 1, wherein the plurality of common liquid chambers are extended to be mutually parallel.

3. The liquid jetting head according to claim 1, wherein a plurality of first liquid supply portions which communicate with one of the end portions of the common liquid chambers, respectively, is formed at one side in a direction in which the nozzle row is extended, on an opposite side of the nozzle surface of the cavity unit, and a plurality of second liquid supply portions which communicate with the other of the end portions of the common liquid chambers, respectively, is formed at the other side in the direction in which the nozzle row is extended, and a flow velocity of the liquid in one of the first liquid supply portions is different from the flow velocity of the liquid in one of the second liquid supply portions, in each of the common liquid chamber, and a flow velocity in one of the first liquid supply portions in the one of the common liquid chambers is different from a flow velocity in one of the first liquid supply portions in the adjacent common liquid chamber, and a flow velocity in one of the second liquid supply portions in the one of the common liquid chamber is different from a flow velocity in one of the second liquid supply portions in the adjacent common liquid chamber.

4. The liquid jetting head according to claim 3, wherein the first liquid supply portions are provided with a plurality of first filters, respectively, and the second liquid supply portions are provided with a plurality of second filters, respectively, and each of the first filters and each of the second filters are formed in one of the common liquid chambers so that a resistance of the each of the first filter is different from a resistance of the each of the second filter, and that the flow velocity of the liquid in the one of the first liquid supply portions is different from the flow velocity of the liquid in the one of the second liquid supply portion.

5. The liquid jetting head according to claim 4, further comprising: a first base member which is provided in common with the first filters; and a second base member which is provided in common with the second filters.

6. The liquid jetting head according to claim 4, wherein a diameter of a plurality of through holes formed in one of the first filters is different from a diameter of a plurality of through holes formed in one of the second filters in each of the common liquid chambers.

7. The liquid jetting head according to claim 4, wherein an aperture rate of one of the first filters is different from an aperture rate of one of the second filters in each of the common liquid chambers.

8. The liquid jetting head according to claim 3, wherein in each of the common liquid chambers, an area of an opening formed in one of the first liquid supply portions and an area of an opening formed in one of the second liquid supply portions are formed to differ so that the flow velocity of the liquid in the one of the first liquid supply portions is different from the flow velocity of the liquid in the one of the second liquid supply portions.

9. The liquid jetting head according to claim 1, wherein a plurality of first liquid supply portions which communicate with one of the end portions of the common liquid chambers, respectively, is formed at one side in a direction in which the nozzle row is extended, on an opposite side of the nozzle surface of the cavity unit, and a plurality of second liquid supply portions which communicate with the other of the end portions of the common liquid chambers, respectively, is formed at the other end in the direction in which the nozzle row is extended, and the liquid jetting head further comprising:

a plurality of auxiliary channel units which distribute the liquid to the common liquid chambers via the first liquid supply portions and the second liquid supply portions, and which has a plurality of liquid chambers each of which is connected to one of the first liquid supply portions and one of the second liquid supply portions which are communicated with one of the common liquid chambers, wherein the liquid chambers is formed so that, in each of the common liquid chambers, a flow velocity of the liquid in one of the first liquid supply portions is different from a flow velocity of the liquid in one of the second liquid supply portions, that a flow velocity in one of the first liquid supply portions in the one of the common liquid chamber is different from a flow velocity in one of the first liquid supply portions in the adjacent common liquid chamber, and that a flow velocity in one of the second liquid supply portions in the one of the common liquid chambers is different from a flow velocity in one of the second liquid supply portions in the adjacent common liquid chamber.

10. The liquid jetting head according to claim 9, wherein each of the liquid chambers has a first connecting portion which is connected to one of the first liquid supply portions, and a second connecting portion which is connected to one of the second liquid supply portions, and an area of an opening formed in the first connecting portion and an area of an opening formed in the second connecting portion in each of the common liquid chambers are formed to differ so that a flow velocity of the liquid in one of the first liquid supply portions is different from a flow velocity of the liquid in one of the second liquid supply portions.

11. The liquid jetting head according to claim 1, wherein a cross-sectional area of each of the common liquid chambers in a direction perpendicular to a longitudinal direction has a distribution which is not uniform in the longitudinal direction, and a distribution of a cross-sectional area of the one of the common liquid chambers in the longitudinal direction is different from a distribution of a cross-sectional area of the adjacent common liquid chamber in the longitudinal direction.

12. The liquid jetting head according to claim 1, wherein the liquid includes a black ink and a plurality of color inks, and the plurality of common liquid chambers include two common liquid chambers for the black ink, and a plurality of common liquid chambers for the color inks which are provided corresponding to the color inks, respectively, and the positions of the equilibrium points are shifted mutually in the longitudinal direction in the two common liquid chambers for the black ink.

13. An ink-jet printer which jets an ink onto a medium to perform printing, comprising:

a liquid jetting head as defined in claim 1, which jets droplets of the ink onto the medium;

an ink supply mechanism which stores the ink and supplies the ink to the liquid jetting head; and a transporting mechanism which transports the medium to a position facing the liquid jetting head.

* * * * *